73-152 SR
7/25/78 XR 4,102,396

United States Patent [19]
Ransom et al.
[11] 4,102,396
[45] Jul. 25, 1978

[54] DETERMINING RESIDUAL OIL SATURATION FOLLOWING FLOODING

[75] Inventors: Robert C. Ransom, Placentia; LeRoy W. Holm, Fullerton, both of Calif.

[73] Assignee: Union Oil Company of California, Brea, Calif.

[21] Appl. No.: 809,313

[22] Filed: Jun. 23, 1977

[51] Int. Cl.[2] ..... E21B 49/00
[52] U.S. Cl. ..... 166/252; 73/152
[58] Field of Search ..... 166/252, 250; 73/151, 73/152; 250/270

[56] References Cited

U.S. PATENT DOCUMENTS

| | | | |
|---|---|---|---|
| Re. 28,963 | 9/1976 | Fertl | 166/252 |
| 3,282,095 | 11/1966 | Owens | 73/151 |
| 3,333,631 | 8/1967 | Heller | 166/252 |
| 3,562,523 | 2/1971 | Richardson et al. | 250/259 |
| 3,631,245 | 12/1971 | Jorden, Jr. | 250/259 |
| 3,757,575 | 9/1973 | Murphy et al. | 73/152 |
| 3,783,683 | 1/1974 | Murphy et al. | 73/152 |
| 3,817,328 | 6/1974 | Neuman | 166/252 X |
| 3,894,584 | 7/1975 | Fertl | 166/252 X |

*Primary Examiner*—Stephen J. Novosad
*Assistant Examiner*—George A. Suchfield
*Attorney, Agent, or Firm*—Richard C. Hartman; Dean Sandford; Gerald L. Floyd

[57] ABSTRACT

A method for determining the fluid saturation, for example the hydrocarbon saturation, the residual oil saturation or water saturation, of a reservoir following a secondary recovery operation wherein there is injected into the reservoir via a well first hydrocarbons and then a secondary recovery medium to return the portion of the reservoir in the immediate vicinity of the well to the same fluid saturation as exists in the bulk of the reservoir. The reservoir is then logged with a logging instrument to determine the hydrocarbon saturation, gas saturation, residual oil and/or water saturation.

25 Claims, No Drawings

DETERMINING RESIDUAL OIL SATURATION FOLLOWING FLOODING

BACKGROUND OF THE INVENTION

1. Field of the Invention

This invention relates to a method for determining in situ the fluid saturation of a fluid-containing subterranean reservoir penetrated by a plurality of wells. More particularly, this invention relates to such a method for determining the fluid saturation in a reservoir which has been subjected to a flooding operation.

2. Description of the Prior Art

In the production of fluids from reservoirs or the injection of fluids into reservoirs, it is often desirable to estimate the relative amounts of the various fluids in place in the reservoir. Such information is helpful in predicting production and/or injection capabilities of the reservoir. This information is especially useful in planning tertiary oil recovery processes which are often expensive and time consuming. In order to design an optimum tertiary recovery process, a knowledge of the amount of water and/or oil present in the reservoir is highly desirable. Various techniques have evolved for determining the amount of a fluid, for example oil, present in a reservoir. The oil content may be expressed conveniently as a percentage of the volume of the pore space existing in the reservoir. The resulting figure is called the "percentage saturation" of oil. The oil content of a reservoir following a secondary recovery operation is called the "residual oil saturation." Residual oil can remain in the reservoir because of a variety of reasons, such as the secondary recovery fluid failing to sweep through certain portions of the reservoir, the particular secondary recovery fluid employed being inefficient, the secondary recovery operation not being carried out for a sufficient length of time, and the like. Much of this residual oil may still be recoverable by further oil recovery techniques. Residual oil saturation is to be distinguished from "irreducible oil saturation" which is the amonnt of oil which cannot be recovered from the reservoir because of capillary forces. The object of a tertiary recovery operation is to recover as much as possible of the residual oil saturation of the reservoir. One technique for determining residual oil saturation involves lowering a logging tool into a well penetrating the reservoir and logging the well. A typical logging tool is capable of examining the reservoir over an area extending from a few inches up to several feet away from the well. In these logging operations, the water saturation can be determined first and the oil saturation then calculated from this value. While reference is made throughout this discussion to "oil saturation," it is to be understood that these same procedures can also be used to determine "water saturation," "hydrocarbon saturation," and "gas saturation."

Various techniques for determining residual oil saturation using different logging tools are well known in the art. Broadly, any reservoir-property-determining, log-measurement means can be employed. The usual logs are the electrical resistivity pulsed neutron and electromagnetic propagation logs. The various techniques employed generally include logging the reservoir a first time, injecting into the reservoir a fluid or fluids which alter the water in the reservoir, the oil in the reservoir, or both the water and oil, and logging the reservoir a second time. Additional sequences of fluid injection followed by logging can be employed.

U.S. Pat. No. 3,562,523 to Richardson et al, describes a log-inject-log method for determining the residual oil saturation in a reservoir which has undergone a water drive or water-flooding wherein first a nuclear logging tool is positioned opposite the reservoir and the thermal neutron decay is measured. The rate of neutron decay is dependent upon the nuclear capture cross section of the formation rock, the capture cross section of the fluids contained within the reservoir rock, and the volumetric fractions of the rock and the fluids. Next, the aqueous liquid present in the reservoir within the radius of investigation of the logging tool is displaced by a second aqueous liquid having a materially different capture cross section than the aqueous liquid originally in place without disturbing the oil phase present in the reservoir. The thermal neutron decay is measured again. The water saturation is determined from the difference between the two thermal neutron decay measurements. The residual oil saturation is determined by difference. Previous procedures using a resistivity logging tool are discussed.

U.S. Pat. No. 3,631,245 to Jorden, Jr. describes a process similar to the above except that rather than displacing the aqueous phase originally in place, in indigenous oil phase is removed and replaced with an aqueous phase substantially equivalent in composition to the aqueous phase originally in place.

During a conventional secondary recovery operation, large amounts of a secondary recovery fluid are injected into the reservoir via one or more injection wells and fluids are withdrawn from the reservoir via one or more production wells. A study of the flow pattern of secondary recovery fluids passing through a reservoir shows that a relatively large amount of fluid passes through the portion of the reservoir immediately surrounding the spaced injection and production wells as compared with the amount passing through the bulk of reservoir between the wells. Thus, the fluid content of the reservoir in the vicinity of a well previously used in a secondary recovery process often will not be representative of the fluid content throughout the bulk of the reservoir. This means that logging such a well will provide a result which is not representative of the saturation throughout the bulk of the reservoir.

U.S. Pat. No. 3,757,575 to Murphy et al. describes a method for determining the residual oil saturation of a reservoir by a log-inject-log technique using either an electrical resistivity log or a Thermal Decay Time Log, a trademark of Schlumberger Well Services. A well penetrating the reservoir is first prepared in a manner such that the gas, oil and water saturation conditions adjacent the wellbore are representative of those out in the reservoir remote from the well. This is accomplished by controlled production of the well, i.e., producing the well at a very slow rate so as to have a small pressure drop between the well and the reservoir remote from the well. A first log is run. A first drive fluid is injected to reduce the oil saturation to zero in the volume of reservoir investigated by the log. A second drive fluid having similar characteristics to the formation water is injected to displace the first drive fluid. A second log is run.

Thus, Murphy et al. recognize that in logging wells to determine residual oil saturation, the reservoir adjacent the wellbore must be prepared so that the fluid saturation conditions there are representative of those on out in the bulk of the reservoir. However, they propose a solution to this problem in which the problem must be recognized well in advance of the time it is desired to determine the residual oil saturation. The method can be quite time consuming. During the time the well must be produced at a very slow rate, a large quantity of potential oil production will be lost. In contrast, the method of the instant invention can be carried out in a relatively short period of time regardless of a well's prior production and/or injection history.

Accordingly, a principal object of this invention is to provide an improved process for determining the fluid saturation, e.g., the oil saturation, in a subterranean oil-bearing reservoir.

Another object of the invention is to provide such a process which is operable in a reservoir which has been flooded.

Still another object of the invention is to provide such a process which is operable in a well penetrating such a reservoir wherein the fluid saturation in the reservoir immediately adjacent the well is different from that in the bulk of the formation.

A further object of the invention is to provide a process for determining the residual oil saturation of a reservoir which has been waterflooded, which saturation is representative of that in the main body of the reservoir, in equivalent rock quality, substantially removed from a well penetrating the reservoir.

Other objects, advantages and features of this invention will be apparent from the following detailed description.

SUMMARY OF THE INVENTION

Briefly, this invention contemplates a process for determining, by means of a logging technique, the residual fluid saturation, for example the residual oil saturation, i.e., the amount of oil remaining in an oil-bearing subterranean reservoir penetrated by a well following exposure of the reservoir to a flooding medium. The portion of the reservoir immediately surrounding the well up to a depth at least equal to the radius of investigation of the logging tool is returned to as near as possible, the conditions of gas, oil and water saturation existing before flooding by injecting therein a hydrocarbon fluid which is the same or substantially similar in composition to that produced from the reservoir via the same or another well. The hydrocarbon fluid is injected in an amount sufficient to at least about saturate the above-described portion of the reservoir. In one method of operation, this portion of the reservoir is overflushed with hydrocarbon fluid. Next, a quantity of a flooding medium which is the same or similar to the original flooding medium is injected into the reservoir to expose the portion of the reservoir immediately surrounding the wellbore to approximately the same amount of flooding medium as was passed through the main portion of the reservoir during the original flooding operation. The reservoir is then logged according to well known procedures with well known instruments, e.g., such as using an electrical resistivity logging tool, a pulsed neutron logging tool, or an electromagnetic propagation device, as part of the requirement in determining the water saturation, the residual hydrocarbon saturation and the residual oil saturation in the reservoir immediately surrounding the well. The saturation computed from the measurements is representative of the residual oil saturation in similar or equivalent rock in the bulk of the reservoir remote from the well in which the investigation is carried out. The logging procedure typically involves logging the well a first time, injecting either an aqueous base fluid or an oil base fluid to change the character of the fluids in the immediate vicinity of the well, and logging the well a second time.

DETAILED DESCRIPTION OF THE INVENTION

After a secondary recovery process has been carried out in a reservoir, it is often desired to determine the residual fluid saturation, i.e., the percent of the pore volume occupied by each of the fluids in the reservoir. The fluids of most interest are hydrocarbons and water. The hydrocarbons may be gas and/or oil. Of chief concern is the residual oil saturation. It is to be understood that although this discussion is directed principally to the determination of residual oil saturation, the same process can also be used to determine residual hydrocarbon saturation, residual gas saturation, and/or residual water saturation.

Various logging methods are known to determine the residual oil saturation of a reservoir penetrated by a well. which reservoir has been subjected to a secondary recovery treatment. Broadly speaking, such methods involve logging the reservoir a first time, injecting a fluid to change the character of the reservoir surrounding the well and logging the reservoir a second time. In some procedures other fluids may be subsequently injected and the reservoir logged after injection of each fluid. The residual oil saturation can be calculated from the results of the two or more logging runs. Such a procedure assumes that the reservoir near the well has the same residual oil saturation as the bulk of the reservoir. This assumption has been found to be erroneous since, due to the radial nature of the flow, the portion of the reservoir immediately surrounding the well has been exposed to the flow of a relatively large volume of fluid per unit volume as compared to the bulk of the reservoir more remote from the well. In determining the success of secondary recovery operations and the feasibility of tertiary recovery operations, the oil saturation of highest interest is that existing in the bulk of the reservoir which constitutes substantially all of the volume of the reservoir. Thus, it is an essential part of the applicants' method that the reservoir in the immediate vicinity of the well be restored to an oil saturation condition representative of that in the bulk of the reservoir before a logging procedure is carried out. The residual oil saturation calculated by logging the reservoir in the immediate vicinity of the well is then more representative of the residual oil saturation in the bulk of the reservoir.

The flow of fluids through a reservoir during a secondary recovery operation is a complex situation depending upon such diverse factors as the degree of homogeneity or heterogeneity of the reservoir, and the type of rock, the pattern of wells being used, the original fluid content of the reservoir, the character and volume of secondary recovery fluid used, and the like. However, for a specific reservoir in which a secondary recovery process has been carried out, the amount of secondary recovery fluid that has passed through the bulk of the reservoir can be estimated from a knowledge of the volume of secondary recovery fluid employed and the porosity of the reservoir. In most secondary recovery processes, about 2 to 25 pore volumes of secondary recovery fluid are employed.

The logging tools usually employed have a vertical resolution of up to about 6 feet and a horizontal range of from a few inches to 10 feet or more out into the reservoir. The diameter of the well generally ranges from about 3½ to 10 inches. Thus, the portion of the reservoir whose fluid saturation must be adjusted is a hollow cylinder having a length equal to the length of the vertical resolution of the logging tool, e.g., at least about 6 feet, preferably a length equal to the thickness of the reservoir open to the well, an inside diameter of about 3½ to 10 inches, and an outside diameter of about 2 to 20 feet depending on the logging tool used. The porosity of this relatively small portion of the reservoir can be determined from the logs discussed above, other logs, such as acoustic or density logs, a combination of different logs, or from core samples taken from the well. From the porosity and the size of the cylinder of reservoir which is to be treated, the pore volume of the cylinder can be calculated. Since the pore volume of secondary recovery fluid used in the original secondary recovery process is known, the amount of secondary recovery fluid to be injected to provide the above-described cylindrical portion of the reservoir with the same fluid saturation as that existing in the bulk of the reservoir can be calculated.

In order to adjust the fluid saturation of the portion of the reservoir in the immediate vicinity of a well to the fluid saturation existing in the bulk of the reservoir by injecting fluids therein, it is necessary that the injected fluids have the same or similar wetting properties as the fluids previously present in the reservoir or which were injected during the secondary recovery process. It is preferred that the injected hydrocarbons be the same as those produced from the reservoir and the injected secondary recovery fluid be the same as that used in the previously carried out secondary recovery process. Of course, minor variations in the composition of the fluids can be tolerated. If the hydrocarbons present in the formation are made up of a mixture of both crude oil and gas, which gas comes out of solution during the production of the hydrocarbons, the injected hydrocarbons can be made up of crude oil and gas injected sequentially in any order or simultaneously or mixed together at the surface prior to injection. If the oil and gas exist in separate zones in the reservoir, the injected oil and gas should be injected into the corresponding reservoir zone. The volume of injected hydrocarbons is that required to at least saturate with hydrocarbons the cylinder-like volume surrounding the well which is subsequently subjected to investigation by the logging tool. Generally from about 1.1 to 2.5 gallons of hydrocarbons per cubic foot of cylinder volume are injected. The oil saturation of this cylinder-like volume should now substantially exceed the oil saturation existing prior to any secondary recovery operation.

This same cylinder-like volume is then treated with a secondary recovery fluid which is the same or similar to that previously injected during the secondary recovery process. The volume of secondary recovery fluid injected at this stage is that calculated to expose the pore volume of the cylinder-like volume to the same relative volume of secondary recovery fluid as was passed through the bulk of the reservoir remote from the well during the previously conducted secondary recovery operation. This volume will be only a small fraction of the volume which was produced or injected through this cylindrical environment during the actual secondary recovery process. Generally from about 2.5 to 10 gallons secondary recovery fluid per cubic foot of reservoir is injected. The fluid saturation in the cylinder-like volume is now representative of that existing in the bulk of the reservoir as a result of the secondary recovery operation. Any type of secondary recovery fluid similar to that employed in the actual secondary recovery operation may be employed, such a waterflood, surfactant solutions, soluble oils, microemulsions and the like.

After the reservoir immediately surrounding the wellbore has been altered so as to be representative of the bulk of the reservoir following a flooding operation, the residual oil saturation is determined using well known logging procedures, such as by using an electrical resistivity logging tool, a pulsed neutron logging tool, or an electromagnetic propagation device.

In uncased wells any of the logging tools can be used. Examples of electrical resisitivity logging tools are the Laterolog, Microlaterolog, Proximity Log, Spherically Focused Log, and Micro Spherically Focused Log, all trademarks of Schlumberger Well Services, induction log and lateral log. Examples of pulsed neutron logs are the Thermal Decay Time Log, a trademark of Schlumberger Well Services and the Neutron Lifetime Log, a trademark of Dresser Atlas Division, Dresser Industries, Inc. An example of an electromagnetic propagation device is the Electromagnetic Propagation Tool, a trademark of Schlumberger Well Services. If the well has been cased, hydrocarbon saturation can be determined using any of the pulsed neutron logging tools. The detailed procedure for using each of these logs as well as various methods of calculating fluid saturation, hydrocarbon saturation, residual oil saturation, residual gas saturation and/or water saturation are well known in the art.

The invention is further described by the following examples which are illustrative of specific modes of practicing the invention and are not intended as limiting the scope of the invention defined by the appended claims.

EXAMPLE 1

A subterranean hydrocarbon-containing reservoir is penetrated by a well completed open hole at a depth of from 2,000 to 2,030 feet. The reservoir is waterflooded by injecting through a plurality of injection wells about 2 pore volumes of a waterflood composition comprising a 5 percent by weight sodium chloride brine and recovering produced fluids from a plurality of spaced production wells. The reservoir produces 35° API gravity crude oil. Before starting a tertiary flooding operation, it is desired to determine the residual oil saturation in the reservoir. The reservoir in the immediate vicinity of an injection well is treated to restore that portion of the reservoir to at least its original hyrocarbon saturation by injecting therein at a relatively slow rate of 200 barrels per day 250 barrels of crude oil previously produced from the reservoir. The injection is carried out at a minimum pressure drop to avoid fracturing the reservoir. Next, 600 barrels of a waterflood composition comprising a 5 percent by weight sodium chloride brine is injected via the injection well at a rate of 200 barrels/-day to restore to that portion of the reservoir the same fluid saturation as exists in the bulk of the reservoir. The residual oil saturation of the reservoir is determined as follows:

The saturation equation is based on the Archies relationship:

$$\text{ti } S_w = (R_o/R_t)^{1/n} \quad (1)$$

$$1 - S_w = S_h \quad (2)$$

$$S_h - S_g = S_o \quad (3)$$

where:

$S_w$ = interstitial water saturation, $R_o$ = resistivity of a specific volume of rock, the pore volumes of which have been filled with a specific water solution, where $S_w$ = 100%, $R_t$ = resistivity of fluid-filled rock where the fluid distribution and saturations are representative of those in the bulk of the reservoir, $n$ = saturation exponent. It is usually assumed that $n$ = 2, but it should be determined by experience in the area in which the log is being run, $S_h$ = hydrocarbon saturation, $S_g$ = gas saturation, and $S_o$ = oil saturation.

First, using as an electrical resistivity logging tool a Micro Spherically Focused Log logging tool, a device having a very shallow radial depth of investigation without the adverse effects caused by moderately thick mud cakes and rugose hole, which log is for use in water-based liquid-filled holes, $R_t$ is determined in the resaturated cylinder surrounding the well. Next, the portion of the reservoir adjacent the well which is subject to investigation by the logging tool is chemically treated to make $S_h$, the hydrocarbon saturation, approach 0 by injecting into the reservoir 200 barrels of a soluble oil composition. The soluble oil composition contains 4 volume percent water, 75 volume percent crude oil previously produced from the reservoir and 21 volume percent of a concentrate. The concentrate is prepared by mixing 55.5 volume percent of a preferentially oil-soluble alkyl aryl sulfonate, 34.5 volume percent of a preferentially water-soluble alkyl aryl sulfonate and 10 volume percent of ethylene glycol monobutyl ether. The preferentially oil-soluble alkyl aryl sulfonate is an oil solution containing about 62 weight percent of surface active alkyl aryl sulfonates marketed by the Sonneborn Division of Witco Chemical Company under the trademark Petronate RHL. The preferentially water-soluble alkyl aryl sulfonate is an aqueous solution containing about 30 weight percent of surface active alkyl aryl sulfonates marketed by the Sonneborn Division of Witco Chemical Company under the trademark Petronate 30. Next, a Micro-Spherically Focused Log logging tool is run to determine $R_o$. The above equation is solved for $S_w$. Subtracting the $S_g$, which is 0 is this instance, from $S_h$ gives $S_o$, the desired residual oil saturation.

EXAMPLE 2

The subterranean hydrocarbon-containing reservoir is penetrated by a well completed in a cased hole at a depth of from 2,120 to 2,155 feet. The reservoir is waterflooded by injecting through a plurality of injection wells about 2.5 pore volumes of a waterflood composition comprising a 5 percent by weight sodium chloride brine and recovering produced fluids from a plurality of spaced production wells. The reservoir produces 32° API gravity crude oil. Before starting a tertiary flooding operation, it is desired to determine the residual oil saturation in the reservoir. The reservoir in the immediate vicinity of an injection well is treated to restore that portion of the reservoir to at least its original hydrocarbon saturation by injecting therein at a relatively slow rate of 200 barrels per day 250 barrels of crude oil previously produced from the reservoir. Next, 600 barrels of a waterflood composition comprising a 5 percent by weight sodium chloride brine is injected via the injection well at a rate of 200 barrels per day to restore that portion of the reservoir to the same fluid saturation as exists in the bulk of the reservoir. Before injection of this waterflood composition, its neutron capture cross section is measured in a calibration tank using a Thermal Decay Time Log which measures the macroscopic neutron capture cross section of all material within the 1 to 2 foot radius of investigation of the tool. Next the reservoir is logged using a Thermal Decay Time Log. The following equation is used:

$$\Sigma_{log1} = \Sigma_{ma}(1-\phi) + \Sigma_h(1-S_w)\phi + \Sigma_{w1}S_w\phi \quad (1)$$

Where:

$\Sigma_{log1}$ = Macroscopic neutron capture cross section. Measured by logging tool.

$\Sigma_{ma}$ = Neutron capture cross section of the composite rock framework.

$\phi$ = Porosity compatible to the specific saturation-measuring technique used.

$\Sigma_h$ = Neutron capture cross section of liquid hydrocarbon.

$S_w$ = Interstitial water saturation.

$1-S_w=S_h$ = Hydrocarbon saturation $\Sigma_{w1}$ = Neutron capture cross section of the interstitial water existing at the time the logging tool is used.

The reservoir is then treated by slowly injecting into the area immediately surrounding the well 200 barrels of the same soluble oil composition described in Example 1 above to displace all oil in the 35 foot thick reservoir up to the depth of investigation of the logging tool. The soluble oil composition is in turn flushed out of this portion of the reservoir by injecting 600 barrels of the same waterflood composition described above. The hydrocarbon saturation now approaches 0, $S_h \rightarrow 0$. The reservoir is again logged using a Thermal Decay Time Log.

$$\Sigma_{log2} = \Sigma_{ma}(1-\phi) + \Sigma_{w2}\phi \quad (2)$$

where $\Sigma_{w2} = \Sigma_{w1}$, and where the symbols retain their same meanings as in Equation (1), except for the subscript 2, which denotes the condition after the saturations have been changed.

Subtracting equation (2) from equation (1)

$$(1 - S_w)\phi = \frac{\Sigma_{log1} - \Sigma_{log2}}{\Sigma_h - \Sigma_{w2}} = S_h\phi \quad (3)$$

The reservoir is then further treated by injecting into the area surrounding the well 600 barrels of water having a greatly contrasting neutron capture cross section compared to that of the waterflood composition.

$$\text{Here, } \Sigma_{w3} \neq \Sigma_{w2} \text{ or } \Sigma_{w1} \quad (4)$$

Where, as above, the symbols retain their same meanings as in the previous Equations, except for the subscript which denotes the condition after the saturations have been further changed.

The reservoir is logged again using a Thermal Decay Time Log to derive the displaceable pore volume, $$\Sigma_{log3} = \Sigma_{ma}(1-\phi) + \Sigma_{w3}\phi \quad (5)$$

Subtracting equation (5) from equation (4), $$\phi = \frac{\Sigma_{log2} - \Sigma_{log3}}{\Sigma_{w2} - \Sigma_{w3}} = \phi_{DISP} \quad (6)$$

Where $\phi = {}_{DISP}$ = displaceable pore volume, the hydrodynamically effective pore volume which is invaded by the injection and flooding fluids.

The residual oil saturation, $S_{hr}$, is then calculated by dividing $S_h\phi$ by $\phi_{DISP}$, $$S_{hr} = S_h\phi/\phi_{DISP} \quad (7)$$

While particular embodiments of the invention have been described, it will be understood, of course, that the invention is not limited thereto since many modifications can be made and it is intended to include within the invention such modifications as are within the scope of the claims.

The invention having thus been described, we claim:

1. A process for determining the fluid saturation of a subterranean reservoir penetrated by one or more injection wells and one or more production wells, which reservoir has been subjected to a secondary recovery operation in which a secondary recovery fluid is injected through the injection wells comprising:

(a) first injecting into a selected well hydrocarbons in an amount sufficient to resaturate the portion of the reservoir in the immediate vicinity of the well to at least about its original hydrocarbon content, (b) next injecting into said well a secondary recovery fluid in an amount sufficient to expose said portion of the reservoir in the immediate vicinity of the well to the same volume of secondary recovery fluid as was passed through the bulk of the reservoir during the secondary recovery process, and (c) thereafter logging the well to determine the fluid saturation.

2. The process defined in claim 1 wherein the hydrocarbons injected in step (a) are the same as or similar in composition to the hydrocarbons produced from the reservoir.

3. The process defined in claim 2 wherein the hydrocarbons injected in step (a) comprise both a crude oil and gas.

4. The process defined in claim 2 wherein the hydrocarbons injected in step (a) comprise a crude oil.

5. The process defined in claim 2 wherein the hydrocarbons injected in step (a) have the same or similar wetting properties compared to the hydrocarbons produced from the reservoir.

6. The process defined in claim 1 wherein there is injected in step (a) about 1.1–2.5 gallons of hydrocarbons per cubic foot of reservoir treated.

7. The process defined in claim 1 wherein in step (a) the reservoir in the immediate vicinity of the well is overflushed with hydrocarbons.

8. The process defined in claim 1 wherein the secondary recovery fluid injected in step (b) is the same as or similar in composition to the secondary recovery fluid used in the secondary recovery operation.

9. The process defined in claim 1 wherein the secondary recovery fluid injected in step (b) has the same or similar wetting properties compared to the secondary recovery fluid used in the secondary recovery operation.

10. The process defined in claim 1 wherein there is injected in step (b) about 2.5–10 gallons of secondary recovery fluid per cubic foot of reservoir treated.

11. The process defined in claim 1 wherein the hydrocarbons and secondary recovery fluid are injected in steps (a) and (b) in an amount sufficient to penetrate the reservoir surrounding the well to a depth of at least about 1 to 10 feet.

12. The process defined in claim 1 wherein the hydrocarbons and secondary recovery fluid are injected in steps (a) and (b) in an amount sufficient to restore to that portion of the reservoir surrounding the well which is subject to investigation during the logging of step (c) the fluid saturation existing in the bulk of the reservoir.

13. The process defined in claim 1 wherein the logging is carried out using a log-inject-log technique.

14. The process defined in claim 13 wherein the logging is carried out by:

(a) logging the well a first time, (b) injecting into the reservoir an aqueous base fluid or an oil base fluid to change the character of the fluids in the reservoir in the immediate vicinity of the well, and (c) logging the well a second time.

15. The process defined in claim 1 wherein the logging is carried out using an electrical resistivity logging tool, a pulsed neutron logging tool or an electromagnetic propagation logging tool.

16. The process defined in claim 1 wherein the fluid saturation is the hydrocarbon saturation, residual oil saturation, residual gas saturation or water saturation.

17. The process defined in claim 1 wherein the portion of the reservoir in the immediate vicinity of the well is the portion of the reservoir subject to investigation during the logging of step (c).

18. A process for determining the residual oil saturation of a subterranean reservoir penetrated by one or more injection wells and one or more production wells, which reservoir has been subjected to a secondary recovery operation in which a secondary recovery fluid is injected through the injection wells, comprising sequentially:

(a) injecting into a selected well hydrocarbons of the same type as those produced from the reservoir in an amount sufficient to resaturate the reservoir with hydrocarbons up to a depth of about 1–10 feet from the well, (b) injecting into said well the same or similar secondary recovery fluid as was used in the previously carried out secondary recovery operation in an amount sufficient to expose the reservoir to a depth of about 1–10 feet from the well to the same pore volume of secondary recovery fluid as was passed through the reservoir during the previously carried out secondary recovery process, and (c) logging the well using an electrical resistivity logging tool, a pulsed neutron logging tool or an electromagnetic propagation logging tool to determine the residual oil saturation.

19. The process defined in claim 18 wherein the hydrocarbons injected in step (a) comprise a crude oil.

20. The process defined in claim 18 wherein there is injected in step (a) 1.1–2.5 gallons of hydrocarbons per cubic foot of reservoir treated.

21. The process defined in claim 18 wherein in step (a) the reservoir to a depth of about 1–10 feet from the well is overflushed with hydrocarbons.

22. The process defined in claim 18 wherein there is injected in step (b) about 2.5–10 gallons of secondary recovery fluid per cubic foot of reservoir treated.

23. The process defined in claim 18 wherein the hydrocarbons and secondary recovery fluid are injected in steps (a) and (b) in an amount sufficient to restore to that portion of the reservoir surrounding the well which is subject to investigation during the logging of step (c) the fluid saturation existing in the bulk of the reservoir.

24. The process defined in claim 18 wherein the logging is carried out using a log-inject-log technique.

25. The process defined in claim 18 wherein the logging is carried out by:

(a) logging the well a first time, (b) injecting into the reservoir an aqueous base fluid or an oil base fluid to change the character of the fluids in the reservoir in the immediate vicinity of the well, and (c) logging the well a second time.

* * * * *

UNITED STATES PATENT OFFICE

CERTIFICATE OF CORRECTION

Patent No. 4,102,396 Dated July 25, 1978

Inventor(s) Robert C. Ransom et al.

It is certified that error appears in the above-identified patent and that said Letters Patent are hereby corrected as shown below:

Column 6, under Example 1, the formula should read --

$$S_w = \left(\frac{R_o}{R_t}\right)^{1/n}$$

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*